US006863470B2

(12) United States Patent
Eggleton et al.

(10) Patent No.: US 6,863,470 B2
(45) Date of Patent: Mar. 8, 2005

(54) CURB FORMING APPARATUS AND METHODS

(76) Inventors: Richard Clive Eggleton, 25 Anderson Court, Bonogin 4213, Queensland (AU); Samuel Sebastian Eggleton, 25 Anderson Court, Bonogin 4213, Queensland (AU)

( * ) Notice: Subject to any disclaimer, the term of this patent is extended or adjusted under 35 U.S.C. 154(b) by 0 days.

(21) Appl. No.: 10/318,910

(22) Filed: Dec. 13, 2002

(65) Prior Publication Data

US 2003/0113165 A1 Jun. 19, 2003

(30) Foreign Application Priority Data

Dec. 14, 2001 (AU) ..... PR9476

(51) Int. Cl.[7] ..... E01C 11/22
(52) U.S. Cl. ..... 404/98; 404/97; 404/105; 425/218
(58) Field of Search ..... 404/97, 98, 105, 404/110, 106; 425/458, 218; 280/96, 43.1, 43.2, 43.22, 81.5, 86.757, 103; 180/19.2, 332

(56) References Cited

U.S. PATENT DOCUMENTS 2,049,502 A * 8/1936 Hufferd et al. ..... 403/138
2,650,106 A * 8/1953 French ..... 280/93.511
3,733,141 A * 5/1973 James, III. ..... 404/98
3,938,822 A * 2/1976 Guerriero ..... 280/86.758
3,950,006 A * 4/1976 Wood, Jr. ..... 280/93.511
3,997,278 A * 12/1976 Riedl ..... 404/133.1
4,310,293 A * 1/1982 Eggleton ..... 425/62
4,411,554 A * 10/1983 Gratzfeld ..... 404/110
4,566,823 A * 1/1986 May ..... 404/98
4,936,763 A * 6/1990 Thomas ..... 425/64
5,018,955 A * 5/1991 Parrish et al. ..... 425/64
5,527,129 A * 6/1996 McKinnon ..... 404/98
6,189,660 B1 * 2/2001 Hu ..... 188/82.1
6,293,728 B1 * 9/2001 Eggleton et al. ..... 404/98
2002/0021938 A1 * 2/2002 Mattias et al. ..... 404/98

* cited by examiner

*Primary Examiner*—Thomas B. Will
*Assistant Examiner*—Raymond W Addie
(74) *Attorney, Agent, or Firm*—Parsons & Goltry; Michael W. Goltry; Robert A. Parsons

(57) ABSTRACT

A device for receiving and pushing hardenable material through a channel defined by a mold of the device to form a curb having an outer surface, and an attached steering assembly consisting of a steering arm coupling wheel supports attached to the device, and adjustment assembly associated with the steering arm and the device for defining different turning radiuses of the wheel supports.

19 Claims, 8 Drawing Sheets

45
43
PRIOR ART
42
40
41
90
60
30
28
26
26
24
46
27
61
21

CURB FORMING APPARATUS AND METHODS

This application claims the benefit of previously filed Australian Provisional Patent Application Number PR9476 entitled "IMPROVEMENTS IN MACHINES FOR LAYING CONCRETE EDGE STRIPS" filed 14 Dec. 2001 by Richard Clive Eggleton and Samuel Sebastian Eggleton.

FIELD OF THE INVENTION

This invention concerns curbing and, more particularly, improved curb architectures and curb forming apparatus and methods.

BACKGROUND OF THE INVENTION

A curb is a border that forms an enclosing or dividing framework or part of a gutter along the edge of a street. Although curbing, especially concrete curbing, exhibits important structural and functional characteristics, its aesthetic appeal is now beginning to prove desirable in landscape architecture. With the availability of concrete dies and specially designed curb forming devices (also referred to "edging devices" or "edging machines"), concrete curbing can be extruded in a wide variety of colors and shapes.

Curb forming devices are machines that move forward by the action of a ram, driven by a motor, which pushes concrete from the base of a hopper into a mold that extends from the back of the machine. The mold has a cross-section that is generally the shape of an inverted U, in which the ends of the arms of the U are directed against the ground. The ram pushes against the concrete until the mould has been filled with it. Pressure on the ram when it continues to push against the concrete drives the edging machine forward.

A typical curb forming apparatus has two forwardly mounted wheels. The wheels rotate on their axles or hubs, supported on respective wheel forks, which are at the lower ends of respective tubular, telescopic wheel supports. The wheel supports are mounted toward each end of a wheel support plate, which is connected to the motor housing of the machine. The tubular, telescopic arrangement enables the distance of each wheel from the wheel support plate to be adjusted (for example, when the machine is used to lay edging strips across sloping ground).

A short bar or "fork bar" is attached to and extends forwardly from each fork. The fork bars have short bolts on their tops. The two ends of a steering rod fit over the short bolts, so that when one fork bar is moved, the other fork bar moves by the same amount. A steering lever is connected to one of the fork bars, which extends further from the top of its associated fork than the other fork bar.

This edging machine has generally functioned well. However, when the garden or other region in which edging strips are being laid is not level, the wheels of the edging machine have to be set at different heights to ensure that the wheel support plate is substantially horizontal. This means that the steering rod, which is connected to the two fork bars, cannot be horizontal. A consequence of this is a net toe-in of the wheels. Under these conditions, it is difficult for an operator of the edging machine control the steering of the machine.

In view of these and other deficiencies in the art, the continued need for new and useful improvements is evident.

SUMMARY OF THE INVENTION

The above problems and others are at least partially solved and the above purposes and others realized in new and improved curb architectures and curb forming apparatus and methods. In accordance with the principle of the invention, an exemplary curb forming apparatus embodiment consists of a device a device for receiving and pushing hardenable material through a channel defined by a mold of the device to form a curb having an outer surface. The device is furnished with an attached steering assembly, which has a steering rod or arm coupling first and second wheel supports attached to the device. The steering assembly incorporates means associated with the steering arm and the device for defining different turning radiuses of the first and second wheel supports. In one embodiment, the means associated with the steering arm and the device for defining different turning radiuses of the first and second wheel supports is a scale. In another embodiment, the mechanism associated with the steering arm and the device for defining different turning radiuses of the first and second wheel supports is an attached stop capable of interacting with an attached abutment.

Preferably, the steering arm is mounted to the device for movement between raised and lowered positions. A wheel is attached to one of the first and second wheel supports, and a ratchet assembly interacts with the wheel permitting rotation of the wheel in only one direction. First and second opposing parallel guides are attached to the first and second wheel supports, respectively. The steering arm has a first end reciprocated to the first guide and a second end reciprocated to the second guide, in which the steering arm is mounted for reciprocal movement and maintained in a substantially horizontal attitude between the first and second opposing parallel guides.

In accordance with the invention a first member is rotated to the device, and an attachment arrangement, such as a worm drive, interacts with the first member and the first wheel support, in which movement, such as rotation, of the first member urges reciprocal movement of the first wheel support. A second member is also rotated to the device, and an attachment arrangement, such as a worm drive, interacts with the second member and the second wheel support, in which movement, such as rotation, of the second member urges reciprocal movement of the second wheel support. The immediate embodiment also incorporates an attached brake movable between a first position away from the wheel and a second position engaging the wheel inhibiting it from rotating.

Consistent with the foregoing, the invention contemplates associated curb forming apparatus and methods and curbs formed with such curb forming apparatus and methods.

BRIEF DESCRIPTION OF THE DRAWINGS

Referring to the drawings:

FIG. 15 is an isometric view of curb forming apparatus constructed and arranged in accordance with an alternate embodiment of the invention including a device for pushing hardenable material through a channel defined by a mold and an attached steering assembly;

DETAILED DESCRIPTION OF PREFERRED EMBODIMENTS

The present invention provides, among other things, new and improved curb architectures, and curb forming apparatus and methods. Ensuing embodiments of the invention are easy to use and construct, and prove exemplary for enhancing not only the aesthetic but also the structural and functional characteristics of extruded curbing. In the interest of clarity of the ensuing discussion, §A discloses the structural and functional attributes of a new and improved curb forming apparatus, §B discloses new and improved curb architectures, §C discloses various embodiments of extrusion molds of the invention, §D discloses a hand trowel for forming a groove into hardenable material, §E discloses new and improved stamp apparatus for introducing an impression into an extruded curb, §F discloses an alternate embodiment of curb forming apparatus incorporating an improved steering assembly, including a brake and a ratchet assembly, §G discloses an improved compaction assembly, and §H discloses extrusion molds with attached mold inserts.

§A. Curb Forming Apparatus

Figure 1:
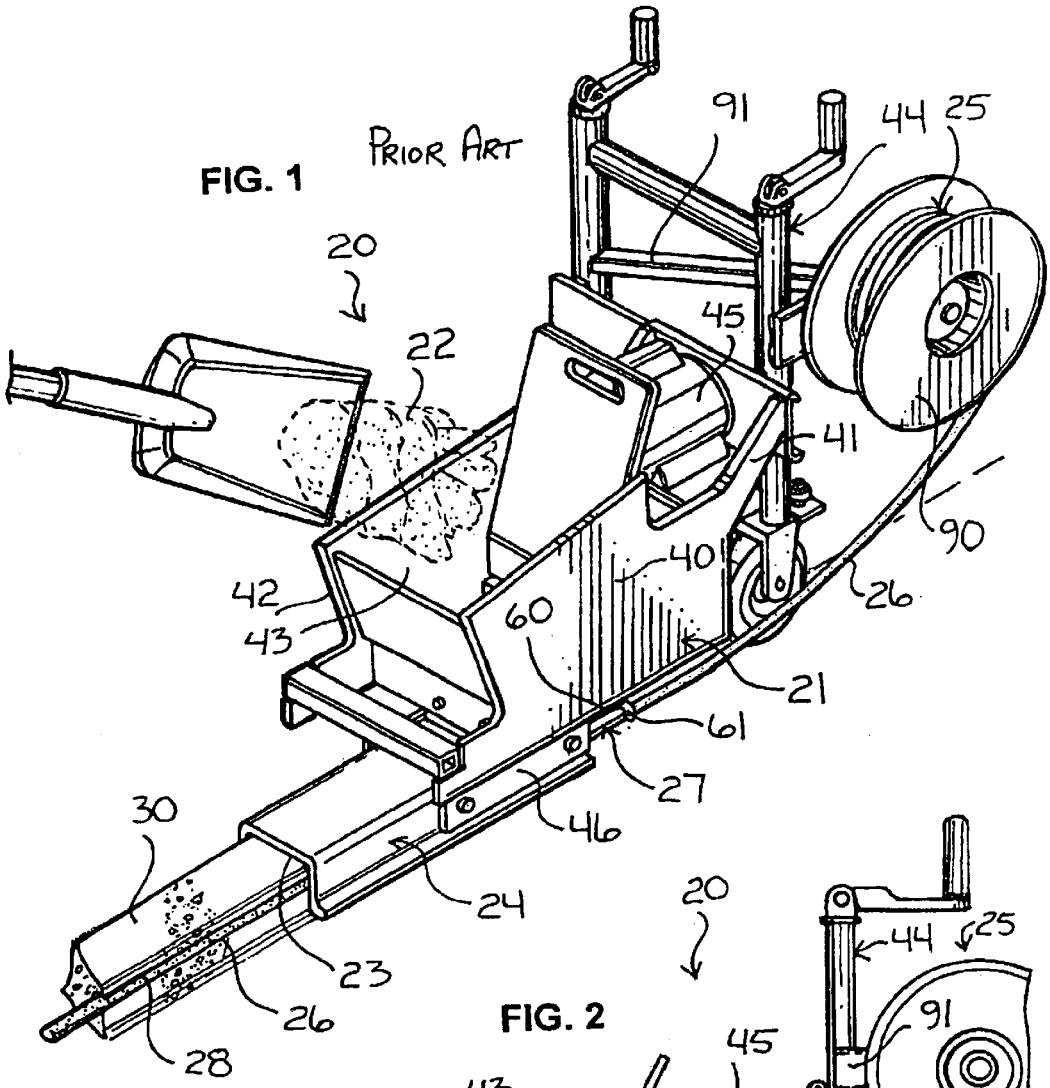
PRIOR ART FIG. 1
FIG. 1 is an isometric view of curb forming apparatus including a device for pushing hardenable material through a channel defined by a mold, a source of elongate stock and a feed for forming a groove into the hardenable material and for supplying the elongate stock to the groove.

Turning now to the drawings, in which like reference characters indicate corresponding elements throughout the several views, FIG. 1 illustrates an isometric view of curb forming apparatus 20, constructed in accordance with the principle of the invention, including a device 21 for pushing hardenable material 22 through a channel 23 defined by a mold 24 to form a curb 30 upon a surface, a source 25 of elongate stock 26 and a feed 27 for forming a groove 28 into curb 30 and for supplying elongate stock 26 to groove 28. Device 21 is generally representative of a typical curb forming device for extruding hardenable material including concrete, asphalt, plastic, etc., in curb form. As a matter of example, device 21 is the apparatus disclosed in U.S. Pat. No. 4,310,293 of Jan. 12, 1982, for APPARATUS FOR MOULDING CONCRETE to Richard C. Eggleton, which is incorporated by reference herein. The structure and function of device 21 are clearly set forth in U.S. Pat. No. 4,310,293, and will not be discussed in great detail except to the extent necessary to provide a complete disclosure.

Figure 2:
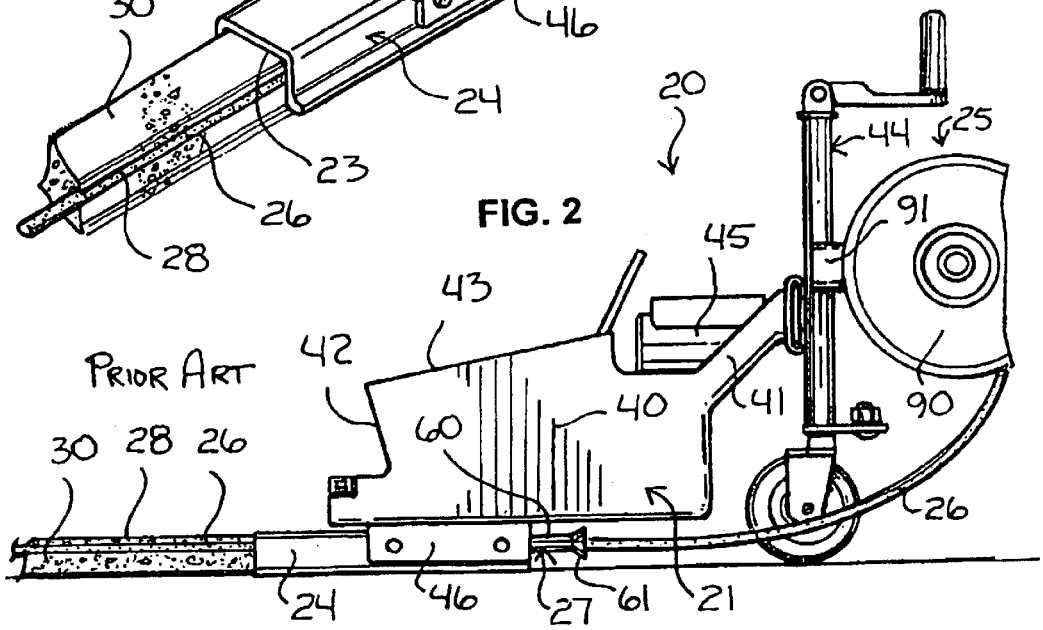
FIG. 2 is a side view of the curb forming apparatus of FIG. 1.

Regarding FIGS. 1 and 2, device 21 consists of a framework 40 having an upstream end 41 and a downstream end 42. Framework 40 supports or otherwise defines a hopper 43 for receiving and containing hardenable material and feeding it to mold 24, which faces the surface that will support an extruded curb. In this example, hopper 43 is positioned toward downstream end 42. Framework 40 also supports a wheeled steering assembly 44 at its upstream end 41, and a compaction assembly including a ram plate (not shown) mounted upstream of mold 24 and a motor 45 for driving the ram plate in a reciprocally linear direction for compacting and pushing the hardenable material through mold 24. The compacting and pushing of hardenable material through mold 24 drives curb forming apparatus 20 in a direction leading with upstream end 41, leaving the extruded or molded curb 30 trailing behind downstream end 42. In this embodiment, mold 24 is carried by a fixture 46 mounted to framework 40 adjacent downstream end 42. However, framework 40 may support mold 24 directly if desired. Steering assembly 44 is used to steer device 21 in a conventional manner.

Figures 3, 4, 5, 6, 7, 8, 9:
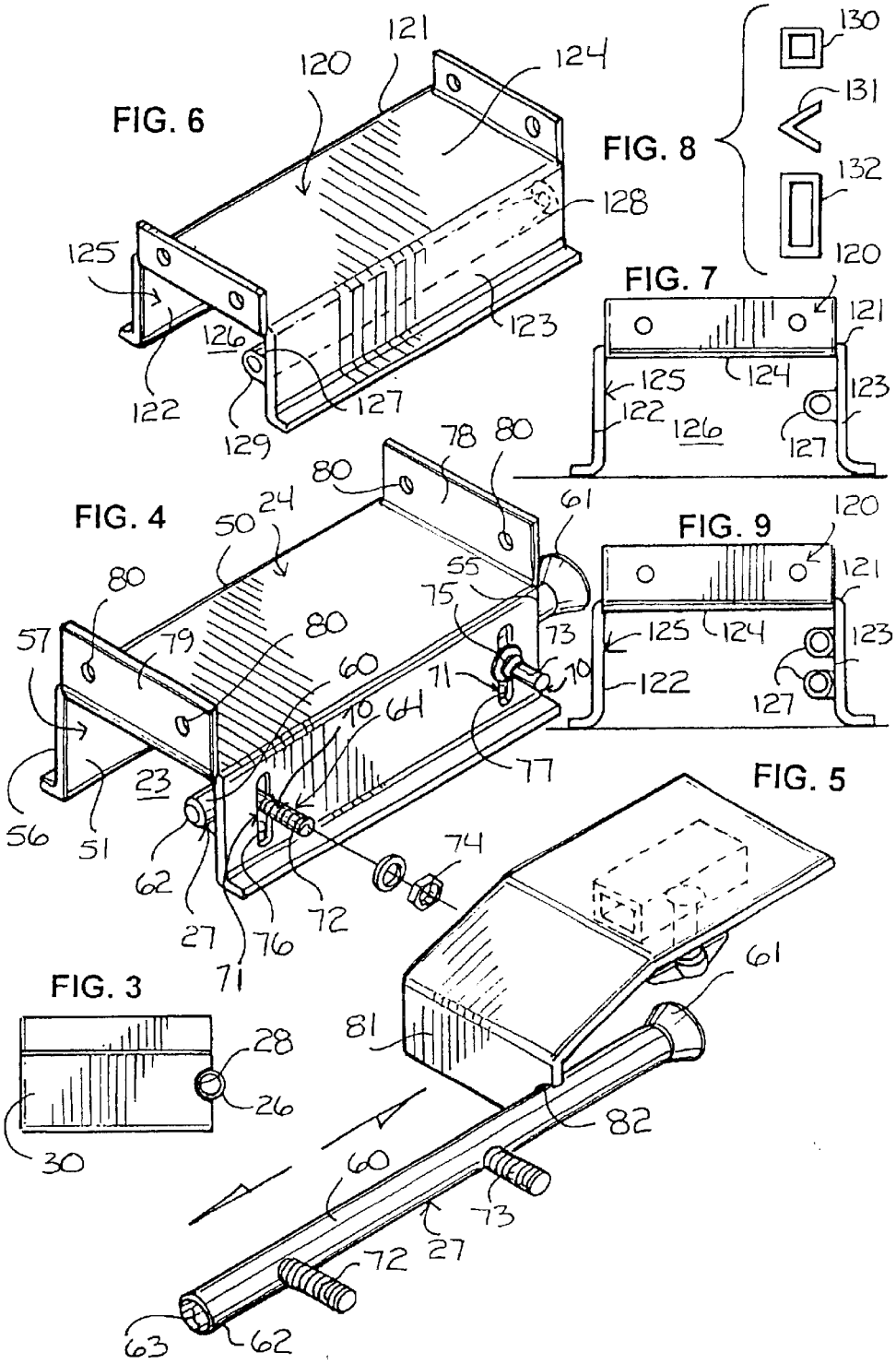
FIG. 3 is a vertical sectional view of a curb formed with the curb forming apparatus of FIG. 1.
FIG. 4 is an isometric view of an embodiment of a mold for receiving hardenable material therethrough from the device of FIG. 1 and the feed shown as it would appear carried by the mold.
FIG. 5 is an isometric view of the feed of FIG. 4.
FIG. 6 is an isometric view of another embodiment of a mold for receiving hardenable material therethrough from the device of FIG. 1, the mold supporting a protuberance for forming a groove into the hardenable material.
FIG. 7 is a side view of the mold of FIG. 6.
FIG. 8 are cross sectional views of embodiments of protuberances that may be employed with the mold of FIG. 6.
FIG. 9 is a side view of yet another embodiment of a mold for receiving hardenable material therethrough from the device of FIG. 1, the mold supporting a pair of protuberances each for forming a groove into the hardenable material.

Turning to FIG. 4, mold 24 is preferably constructed of steel, aluminum or other selected metal and consists of a generally U-shaped body 50 having sidewalls 51 and 52 that depend from an endwall 53 in spaced-apart and substantially parallel relation. Sidewalls 51 and 52 and endwall 53 cooperate to define an inner surface 57 that bounds or defines channel 23 which extends through body 50 from one end 55 to another end 56. Channel 23 is open and normally faces a support surface during extrusion operations. Those of ordinary skill will appreciate that by varying the manufacture of body 50, channel 23 may be provided in a variety of shapes and forms as desired.

In this embodiment, body 50 supports feed 27. Consistent with the ensuing discussion, feed 27 may be mounted to framework 40 if desired. During extrusion operations, feed 27, which is a structural component, forms groove 28 (FIGS. 1 and 2) into curb 30 and supplies elongate stock 26 to groove 28. With momentary reference to FIG. 5, feed 27 is comprised of a receptacle or sleeve 60. Preferably constructed of metal, plastic or other substantially rigid material, receptacle 60 is tubular and includes an open upstream end 61 and an open downstream end 62 that both communicate with a passage 63 defined therebetween by receptacle 60. Turning back to FIG. 4, receptacle 60 is mounted to body 50 so as to reside totally or, perhaps, partially in channel 23, with its downstream end 62 positioned adjacent end 55 and its upstream end 61 positioned adjacent end 56. Receptacle 60 is mounted to, or otherwise carried by, sidewall 52 and extends into and, in this embodiment, through channel 23 against that portion of inner surface 57 defined by sidewall 52. Receptacle 60 is further mounted to sidewall 52 for movement between a first or raised position toward endwall 53 and a second different or lowered position away from endwall 53. An engagement assembly 64 provides this mounting and adjustment. Although the present embodiment shows receptacle 60 mounted to sidewall 52, it can be mounted at any location against inner surface 57 along endwall 53 or sidewall 51. The adjustable mounting of receptacle 60 with sidewall 51 would, of course, provide adjustment of receptacle 60 between raised and lowered positions. The adjustable mounting of receptacle 60 to endwall 53, however, would provide adjustment of receptacle from side to side between a position toward sidewall 51 and another position toward sidewall 52.

Engagement assembly 64 includes engagement apparatus 70 supported by receptacle 60 and detachably engagable complemental engagement apparatus 71 supported by sidewall 52. In this embodiment, engagement apparatus 70 includes threaded bolts 72 and 73 carried by and extending from receptacle 60 in spaced-apart and substantially parallel relation, and threaded nuts 74 and 75 each threadably engagable with one of the threaded bolts 72 and 73. Complemental engagement apparatus includes elongate through slots 76 and 77 positioned in spaced-apart and substantially parallel relation. Elongate slot 76 resides adjacent end 56 of body 50, and elongate slot 77 resides adjacent end 55 of body 50. To mount receptacle 60, threaded bolts 72 and 73 may each be passed through one of elongate slots 76 and 77, respectively, and receptacle 60 secured by threadably mounting threaded nuts 54 and 55 each with one of threaded bolts 72 and 73 and tightening them against sidewall 52. Because slots 76 and 77 are elongate, receptacle 60 may be positioned and secured at its raised or lowered positions and at any position therebetween. Those of ordinary skill will understand that a variety of engagement mechanisms may be employed for providing the disclosed adjustable mounting of receptacle 60 including varying forms of adjustable clamp mechanisms, snap fastening mechanisms, etc.

Turning back to FIGS. 1 and 2, mold 24 is preferably mounted to fixture 46 with conventional nuts and bolts so that it may be easily removed and replaced if necessary. Flanges 78 and 79 (FIG. 4) extending upwardly from ends 55 and 56, respectively, have through holes 80 that accommodate bolts for engagement to fixture 46. However, mold 24 can be more permanently affixed to fixture 46 with rivets or welding. When properly mounted, end 55 of mold 24 faces upstream end 41 and end 56 of mold 24 faces downstream end 42. End 55 receives hardenable material from hopper 43 and ram plate compacts and pushes the hardenable material through mold 24 from end 55. In FIG. 5, ram plate 81 resides adjacent receptacle 60 and runs reciprocally along a length of it between its upstream and downstream ends 61. A recess 82 formed into ram plate 81 accommodates the body of receptacle 60 intermediate its upstream and downstream ends 61 and 62. Open upstream end 61 of receptacle 60 extends somewhat outboard of end 55 in a direction toward upstream end 41 of framework 40. As hardenable material is compacted and pushed through mold 24 for extruding a curb, receptacle 60 forms the groove 28 into the hardenable material. The ability to adjust feed 27 at and between its raised and lowered positions gives a user the flexibility to position groove 28 at one or more desired locations.

After extrusion, the hardenable material begins to harden or cure. Prior to curing, the curb is prone to damage or deformation. To inhibit groove 28 from being damaged prior to curing or from collapsing under the weight of the hardenable material after curb 30 formation, receptacle 60 operates to receive and conduct elongate stock 26 into groove 28 during the extrusion operation. Regarding FIG. 1, elongate stock 26 is constructed preferably of a flexible and resilient foam-like material such as Styrofoam or foam-like polyurethane. In the embodiment shown in FIGS. 1 and 2, the source 25 of elongate stock 26 is provided in the form of a roll carried by a reel or spool 90 mounted, in this specific embodiment, for rotation to a framework 91 fixed to steering assembly 44 upstream of feed 27. Alternatively, spool 90 may be mounted directly to steering assembly 44 or directly to framework 40 if desired.

Figures 12, 13, 14:
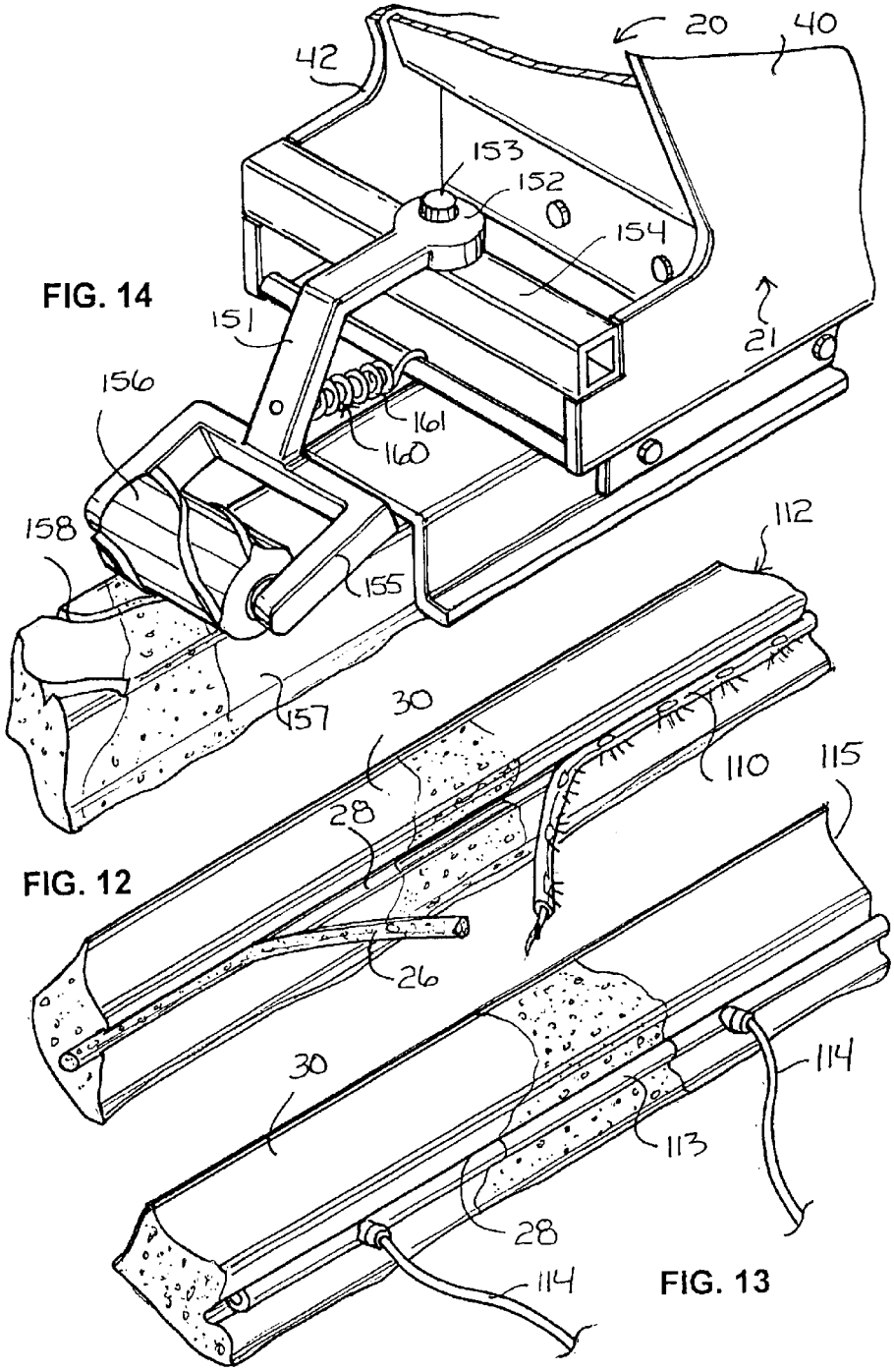
FIG. 12 is a fragmented isometric view of the elongate stock of FIG. 1 shown being removed from a groove formed into a curb and illumination apparatus shown being installed into the groove.
FIG. 13 is a fragmented isometric view of a curb having a groove supporting water distribution apparatus.
FIG. 14 is a fragmented perspective view of the device of FIG. 1 shown having stamp apparatus mounted to form an impression into an extruded curb.

Prior to extruding a curb, a free end of elongate stock 26 may be inserted into and through receptacle 60 from its upstream end 61. Upstream end 61 is somewhat enlarged for facilitating easy insertion, and receptacle 60 is sized for easily accommodating the elongate stock 26. After positioning the free end of the elongate stock 26 somewhat outboard or downstream of receptacle's 60 downstream end 62, extruding operations may commence. As the hardenable material 22 is forced through mold 24, it will pass by feed 27 which will, of course, form the groove 28 into the extruded curb 30. As the extruded curb 30 passes by receptacle's 60 downstream end 62, the elongate stock 26 engages and receives into groove 28. This engagement of elongate stock 26 against and into groove 28 draws elongate stock 26 from its source 25 along with the extruded curb 30. After a desired length of curb has been extruded, the elongate stock 26 may be severed, such as with a knife or scissors, at or adjacent receptacle's 60 upstream end 61 leaving curb 30 as it would appear in FIGS. 1 and 2 and in vertical cross section in FIG. 3. After waiting for a period of time sufficient to allow the concrete or hardenable material to at least partially cure or harden, elongate stock 26 may be grasped and pulled away and removed leaving the exposed groove 28 as shown in FIG. 12. Preferably, the elongate stock 26 should be removed only after the hardenable material or concrete has at least partially hardened or cured to inhibit the hardenable material from being damaged or compromised during removal. Elongate stock 26 maintains the shape of groove 28 and functions to support groove 28 from collapsing either from exposure to an external force or under the weight of the hardenable material.

In the present embodiment, feed 27 extends longitudinally in channel 23 along substantially the entire length of mold 24. It may, as previously mentioned, extend only partially into and through channel 23 if desired. To this end, not only can feed 27 be mounted with only its downstream end 62 extending into channel 23, but the invention contemplates that feed 27 may be mounted with its downstream end 61 extending into channel 23 through the mold 24 body 50. During extrusion operations in this regard, downstream end 61 forms the groove into the hardenable material and delivers the elongate stock 26 to the groove. Furthermore, although curb forming apparatus 20 has been disclosed as having only one feed 27 and one corresponding source of elongate stock 26, more than one feed and more than one source of elongate stock may be employed for forming a curb having a plurality of grooves.

§B. Curb Architectures

After the elongate stock 26 has been removed, groove 28 is available for accommodating an illumination apparatus 110 or a water distribution apparatus 111 (FIG. 13) for forming a useful curb architectures. Should two grooves be formed into a curb, each could certainly accommodate one of the illumination and water distribution apparatus 110 and 111. In the embodiment shown in FIG. 12, illumination apparatus 110 is a conventional device manufactured by RED LEAF INCORPORATED under the DURALIGHT TM trademark. Illumination apparatus 110 is elongate, tubular and flexible, and constructed of a diameter that approximates the diameter of elongate stock 26 so that after elongate stock 26 is removed from groove 28, illumination apparatus 110 may be forced or otherwise inserted into groove 28 in place of the elongate stock 26 as generally shown in FIG. 12. A layer of silicone or other conventional adhesive may be used for providing a rugged adhesion between groove 28 and illumination apparatus 110 if desired. So mounted or otherwise embedded in groove 28, illumination apparatus 110 may be energized with electrical energy for illumination, thus providing the integration of an extruded curb with lighting to form a useful curb architecture or assembly 112. This curb architecture 112 proves very useful in landscaping for providing illumination to sidewalks and pathways, flowers, gardens, etc. Because illumination apparatus 110 is elongate and flexible like elongate stock 26, it may be fed and installed into groove 28 through receptacle 60 during extrusion operations in lieu of elongate stock 26. Illumination apparatus 110 may therefore be carried by a spool mounted either directly or indirectly to framework 40 or steering assembly 44 much like spool 90.

In the embodiment shown in FIG. 13, water distribution apparatus 111 consists of a conduit 113 having one or more outlets 114. Conduit 113 is elongate, tubular, preferably flexible and constructed of a diameter that approximates the diameter of elongate stock 26 so that after elongate stock 26 is removed from groove 28, conduit 113 may be forced or otherwise inserted into groove 28 in place of the elongate stock 26 as shown. A layer of silicone or other conventional adhesive may be used for providing a rugged adhesion between groove 28 and conduit 113 if desired. So mounted or otherwise embedded in groove 28, conduit 113 may be coupled with a water source. The outlets 114 receive water from conduit 113 and disperse it to plants, thus providing the integration of an extruded curb with a watering system to form a useful curb architecture or assembly 115. This curb architecture 115 proves very useful in landscaping not only for a water distribution assembly, but also for concealing, protecting and supporting a watering system.

§C. Extrusion Molds

Groove 28 formation can be accomplished with feed 27 without elongate stock 26 if desired. In this regard, feed 27 would serve as a protuberance extending into channel 23 for forming a groove during extrusion operations. Rather than mounting a protuberance for adjustment like feed 27, a protuberance may be removably mounted at a fixed position or immovably fixed if desired.

In this regard, FIGS. 6 and 7 show a mold 120 that, like mold 24, is a generally U-shaped body 121 including sidewalls 122 and 123 that depend from an endwall 124 in spaced-apart and substantially parallel relation. Sidewalls 122 and 123 and endwall 124 cooperate to define an inner surface 125 that bounds or defines a channel 126 extending therethrough through which hardenable material may be forced. Further included is a protuberance 127 immovably fixed to inner surface 125 defined by sidewall 153. Protuberance 127 may, of course, be mounted to inner surface 125 at other locations. In this embodiment, protuberance 127 is elongate, extends longitudinally along substantially the entire length of body 121 in channel 126 and includes an upstream end 128 and a downstream end 129. Upstream end 128 normally faces the flow of oncoming hardenable material and, in this embodiment, is shown somewhat tapered. Protuberance 127 is either welded to, or integrally formed with, body 121. Protuberance 127 can be constructed and arranged to extend along only a partial length of body 121 if desired.

Although mold 120 is shown having only one protuberance 127, it may include two (FIG. 9) or more such protuberances 127 for forming a curb having a plurality of grooves. Additionally, protuberance 127 is shown having a circular cross section for forming an arcuate or curved groove into hardenable material. FIG. 8 shows protuberances having square 130, triangular 131 and rectangular 132 cross sections. Other geometric shapes may be employed if desired.

§D. Hand Trowel

Figure 10:
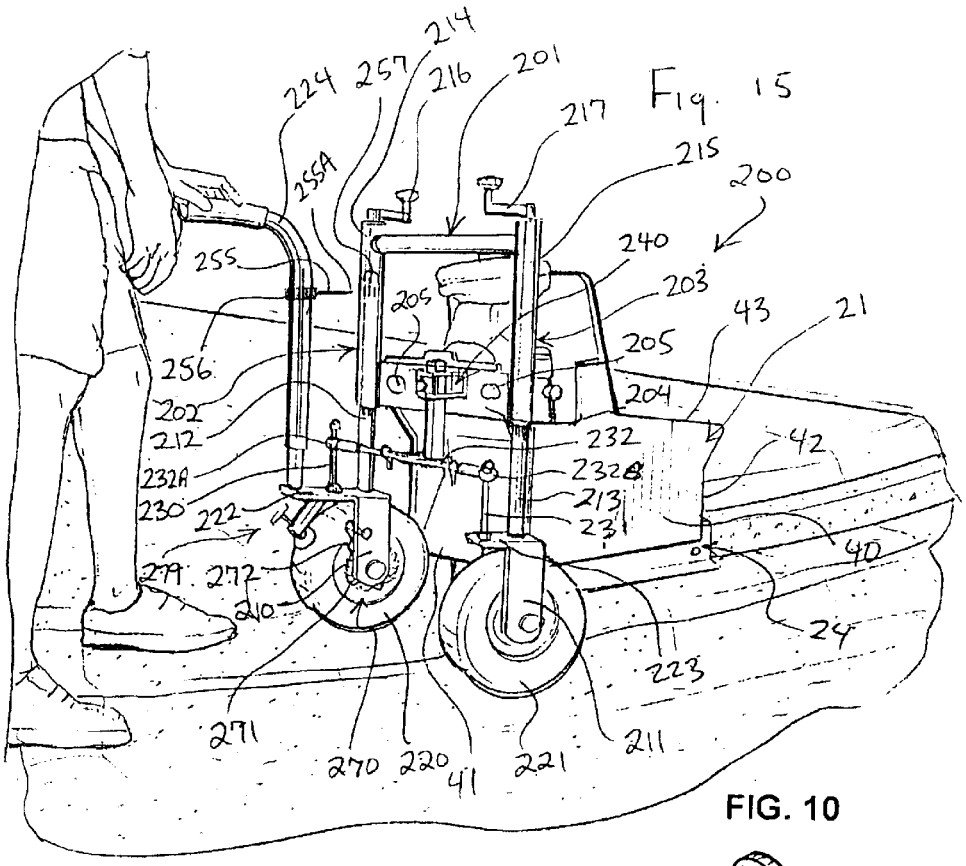
FIG. 10 is an isometric view of a hand trowel for forming a groove into hardenable material.
Figure 11:
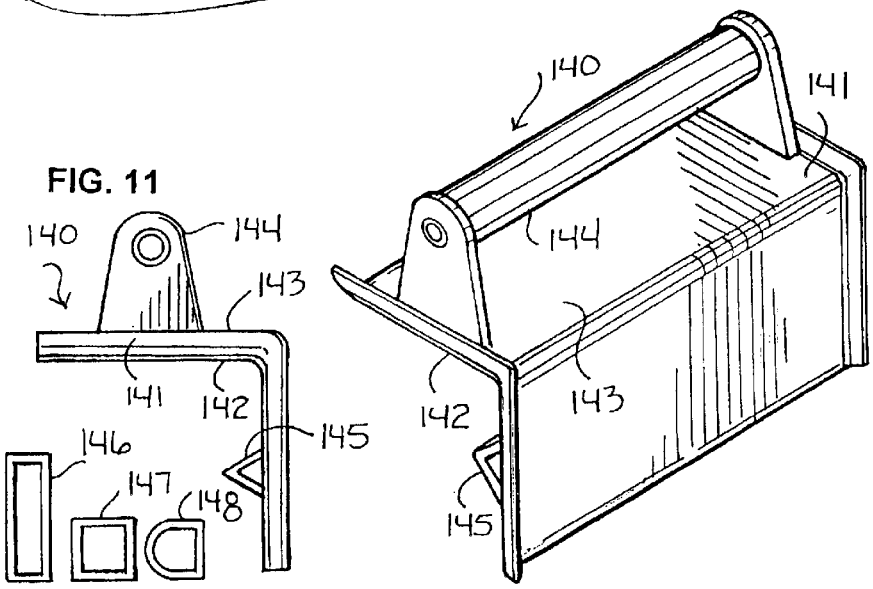
FIG. 11 is a side view of the hand trowel of FIG. 10.

Providing a curb with a groove is important in the construction of each of the curb architectures 112 and 115 discussed in §B, infra. In this regard, rather than form a groove during curb extrusion, a groove may be formed into a curb after extrusion if desired. To that end, FIGS. 10 and 11 show a hand trowel 140, which consists of an angled body 141 having an inner surface 142, an outer surface 143, a handle 144 carried by the angled body 141 adjacent the outer surface 143 and a protuberance 144 mounted, either removably or immovably, to inner surface 142. Before a newly extruded curb hardens or cures, a user may grasp handle 144, such as with his or her hand, support inner surface 142 of hand trowel 140 against the curb and, by moving hand trowel 140 along and against the curb, present protuberance 145 into the curb to form a groove. Although protuberances 145 is shown having a triangular shape, FIG. 11 shows other protuberant shapes that may be used including rectangular 146, square 147, arcuate 148, etc.

§E. Stamp Apparatus

To enhance aesthetic appearance, it is often desirable to form decorative impressions into extruded curbing. FIG. 14 illustrates a stamp apparatus 150 for carrying out this task. In this embodiment, stamp apparatus 150 includes an elongate support 151 having a proximal end 152 mounted for pivotal movement at a pivot point 153 to a transom 154 carried by framework 40 proximate its downstream end 42. Consistent with this discussion, elongate support 151 can be mounted with framework 40 at other locations. Elongate support 151 extends outwardly from transom 154 at terminates with a bifurcated distal end 155 that supports a textured roller 156 for rotation. As a curb 157 is extruded with curb forming apparatus 20, elongate support 151 supports and directs roller 156 against curb 157. As curb forming apparatus 20 moves along, roller 156 rolls across curb 157 leaving a decorative impression 158. A biasing element 160 connects framework 40 with elongate support 151 between its proximal and bifurcated distal ends 152 and 155 and provides a sufficient amount of tension to bias elongate support 151 downwardly for forcing roller 156 to run smoothly across the curb 157 to leave an evenly formed decorative impression 158. Biasing element 160 can consist of a compression spring 161 as shown, an elastomeric element or other suitable biasing mechanism.

§F. Alternate Embodiment of Curb Forming Apparatus

Attention is now directed to FIG. 15, in which is seen curb forming apparatus 200 constructed and arranged in accordance with the principle of the invention. In common to the previous embodiment designated 20, apparatus 200 shares device 21, mold 24, and framework 40 including upstream end 41 and downstream end 42 and hopper 43, which is disposed toward downstream end 42. In accordance with the immediate embodiment, framework 40 supports an attached steering assembly 201 at its upstream end 41.

Steering assembly 201 consists of attached telescopic wheel supports 202,203. In the immediate embodiment, a support plate/member 204 is secured to framework 40, which has opposing ends secured and attached to wheel supports 202,203, respectively, such as by welding. Support plate 204 is secured to framework 40 with handled threaded fasteners 205, although rivets, welding or other suitable means of attachment can be used. Although support plate 204 is preferred for securing wheel supports 202,203 to framework 40, wheel supports 202,203 can be secured to framework 40 in other ways.

At the lower ends of wheel supports 202,203 are forks 210,211. Forks 210,211 are attached to elongate elements 212,213, which extend upwardly therefrom and into sleeves 214,215, respectively. Elongate elements 212,213 are mounted to sleeves 214,215 for movement in reciprocal directions, permitting forks 210,211 to be moved between raised and lowered conditions. Attached at the top ends of sleeves 214,215 are handles 216,217. Conventional worm drives (not shown) attach handles 216,216, to elongate members 212,213, in which rotation of handles 216,217 imparts reciprocal movement of forks 210,211 between their raised and lowered conditions, and this is a well-known arrangement commonly found with the steering assemblies of many conventional curb-forming devices. Other means can be employed between handles 216,217 and elongate supports 212,213 for effecting reciprocal movement of forks 210,211 between their raised and lowered conditions in response to movement of handles 216,217, whether by way of rotational movement of handles 216,217, pivotal movement of handles 216,217, levered movement of handles 216,217, etc.

Wheels 220,221 are mounted to forks 210,211 for rotation, respectively, in a conventional and well known manner. Attached short/fork bars 222,223 extend substantially horizontally from the tops of fork 210,211, respectively. Fork bar 223 is somewhat longer than fork bar 222. Although fork bars 222,223 are preferably welded to forks 210,211, respectively, they can be secured in other ways. The distal extremity or end portion of fork bar 222, which is remote from fork 210, is secured, such as by welding or a threaded attachment or other selected means of attachment, to an upstanding steering handle 224. Steering handle 224 can be secured to fork bar 223, if desired. Fork bars 222,223 can each be provided with an attached steering handle, if desired.

Steering assembly 201 incorporates long bolts or elongate guides 230,231, which are secured, such as by welding or a threaded attachment or other selected means of attachment, to the tops of fork bars 222,223, respectively, and extend upwardly therefrom. The free or distal ends of guides 230,231 are headed, i.e., somewhat enlarged, and guides 230,231 are disposed in a spaced apart and substantially parallel orientation relative to one another. The headed free distal ends of guides 230,231 can be defined by attached bolts, if desired.

Steering assembly 201 incorporates an elongate steering arm or rod 232 having opposing ends 232A,232B, in which end 232A is reciprocated to guide 230 and end 232B is reciprocated to guide 231. A ringed attachment characterizes the reciprocal attachment of end 232A to guide 230 and end 232B to guide 231. More particularly, a ring or circular band characterizes end 232A, through which extends guide 230. Like end 232A, a ring or circular band characterizes end 232B, through which extends guide 231. Guides 230,231 are mounting points for ends 232A,232B of steering rod 232. The interconnection of guides 230,231 with steering rod 232 functions to interconnect forks 210,211. The length of steering rod 232 is such that when it is mounted on guides 230,231, fork bars 17,18 are parallel to each other, as are axles/hubs of wheels 220,221. Movement of handle 224 causes fork bar 222, and thus wheel fork 210, to rotate about a mounting axis of wheel fork 210, and an identical rotation of fork bar 223 and fork 211 as a result of the attachment of guides 230,231 with steering rod 232. By manipulating steering handle 224, apparatus 200 can be steered with steering assembly 201.

And so ends 232A,232B of steering rod 232 are reciprocated to guides 230,231, and can slide up and down guides 230,231. In another perspective, guides 230,231 are capable of reciprocating through ends 232A,232B. With this arrangement, wheel forks 210,211 can be moved reciprocally between retracted conditions toward sleeves 214,215 and extended conditions away from sleeves 214,215. Providing that steering rod 232 is maintained in a substantially horizontal attitude, wheels 220,221 retain their parallel alignment and the steering of apparatus 200 can be effected in the normal manner, without difficulty, and without wheels 220,221 toeing in as with conventional steering arrangements for curb forming devices.

In accordance with the invention, steering rod 232 is secured in a substantially horizontal attitude with a locating assembly 240. Looking to FIG. 16, locating assembly 240 consists of opposing plates 241 (which may be formed by bending a single, elongate plate) affixed to an end of a support member 242, which has an opposing end secured by a clamp 243 affixed to plate 204. Clamp 243 consists of a guide member 244 affixed to plate 204 such as by welding, through which support member 242 is disposed. Support member 242 is secured in place with a threaded clamping element 245 threadably attached to guide member 244. Tightening clamping element 245 against support member 242 secures it in place. When clamping element 245 is loosened, support member 242 is capable of being reciprocated through guide member 244 and moved between lowered and raised positions for the purpose of disposing steering rod 232 at a desired height. After adjusting steering rod 232 to a desired height, tightening clamping element 245 against support member 242 secures it in place. Locating assembly 240 is preferred for securing steering rod 232 in a substantially horizontal attitude, while also permitting the adjustment of steering rod between raised and lowered positions, which permits the reciprocal adjustment of wheel supports 202,203 in order to vary the overall height device 21. It is important to note that although steering rod 232 is secured by plates 241, steering rod 232 is capable of sliding axially through plates 241, enabling steering rod 232 to reciprocate axially through plates 241. This allows for easy steering.

Figure 16:
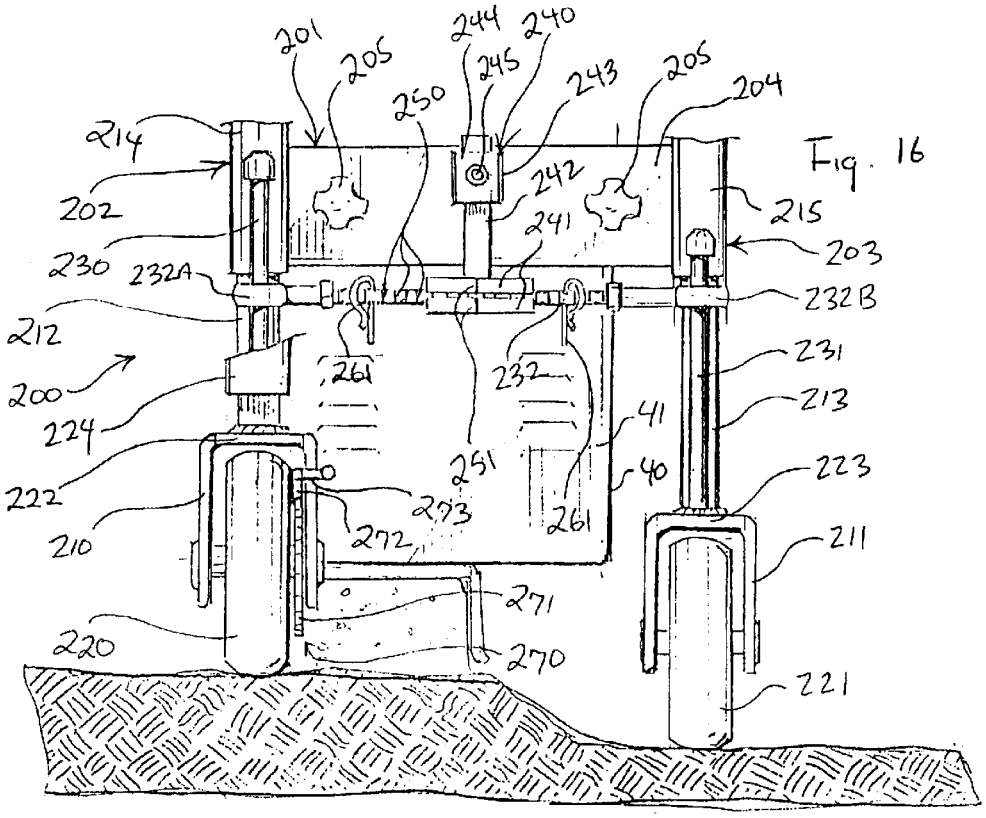
FIG. 16 is a fragmented front elevation of the device of FIG. 15 illustrating the steering assembly.
Figure 21:
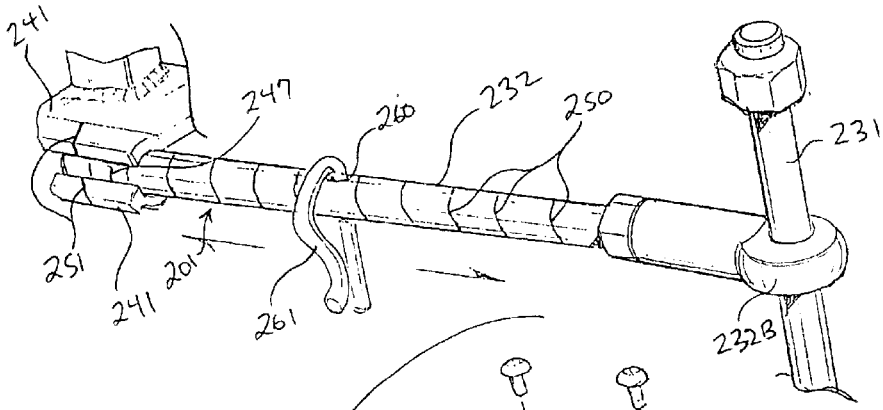
FIG. 21 is an enlarged fragmented perspective view of a steering arm of the steering assembly of the device of FIG. 15.

Referring to FIG. 16, steering rod 232 is provided with a scale, which consists of applied and substantially equally spaced-apart markings 250 that extend along a specified length of steering rod 232 along its central region and a reference marking 251 carried by plates 241. The markings that characterize scale 250 indicate and thus define the radius of curvature of an extruded curb that is laid when steering handle 224 is moved so that reference mark 252 is aligned with a specific one of markings 251 on steering rod 232. As seen in FIG. 21, a gap 247 between plates 241 permits markings 250 to be visualized for the purpose of alignment with a specified one of markings 250 as desired. FIG. 21 is an enlarged fragmented view of steering assembly 201 illustrating steering rod 232, plates 241, gap 247, and the described scale including markings 250 and reference marking 251, in addition to the attachment of end 232B of steering rod 232 to guide 231. Although markings 250 are carried by steering rod 232 and reference markings 251 are carried by plates 241, this can be reversed.

Figure 18:
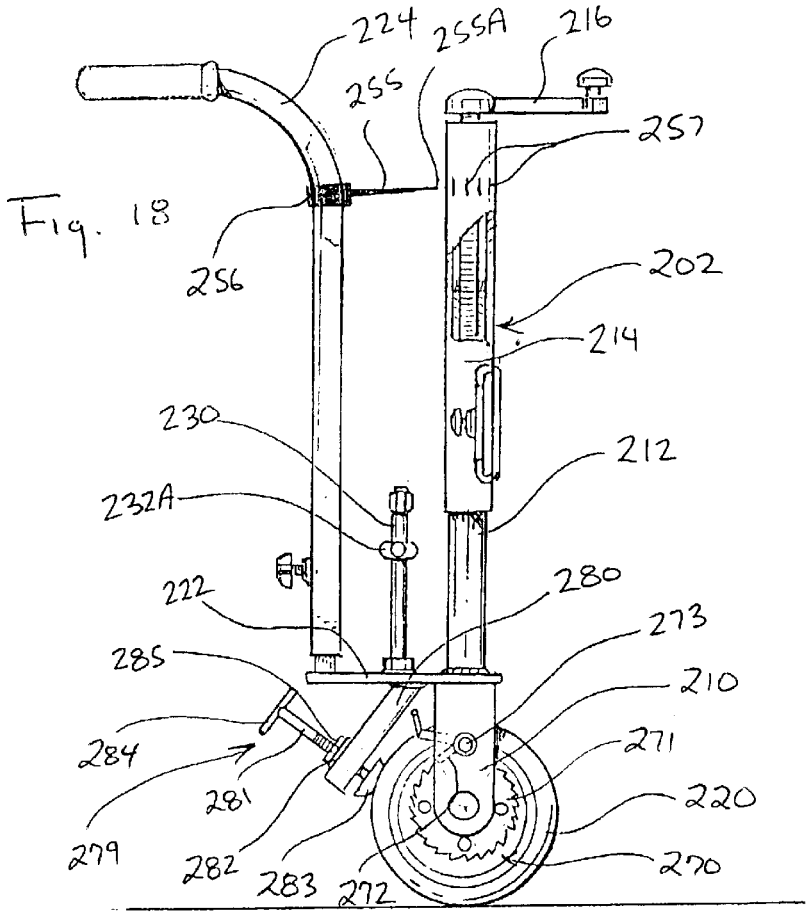
FIG. 18 is a side elevation of a wheel mechanism of the steering assembly of FIG. 15, which incorporates an attached brake and an attached ratchet assembly.

An alternative way of indicating/defining the radius of curvature of an extruded curb is shown in FIGS. 15 and 18, in which there is seen a spike 255 secured to steering handle 224. A clamp 256 secures spike 255 to steering handle 224. Spike 255 can be secured in other ways, such as by welding, etc. Spike 255 extends outwardly from clamp 256 and terminates with a distal or free pointed end 255A, which is directed toward markings 257 carried by sleeve 214, which consist of a series of spaced-apart vertical lines. The required radius of curvature of an extruded curb is achieved when the point of spike 255 is aligned with the appropriate vertical line on sleeve 214.

Figure 17:
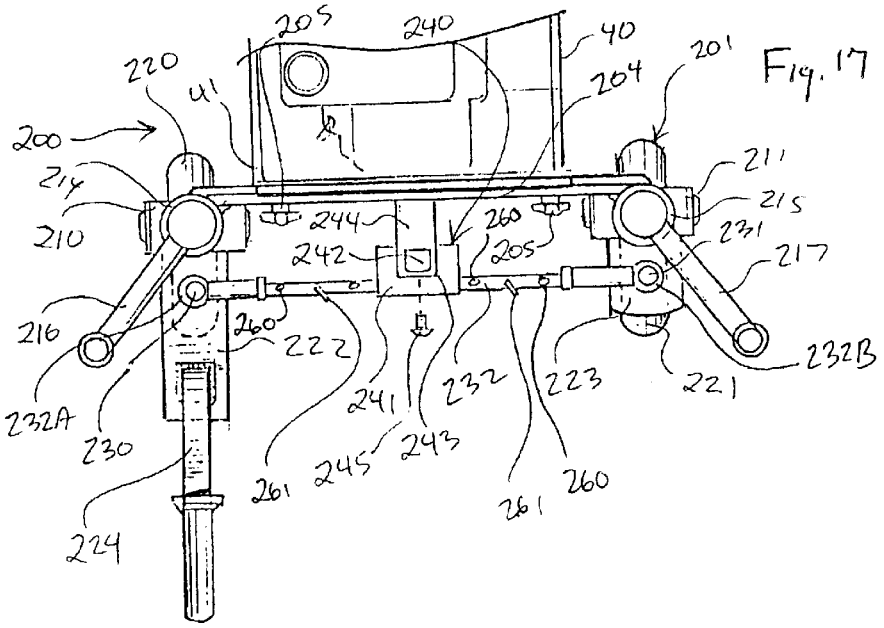
FIG. 17 is a fragmented top elevation of the device of FIG. 15 illustrating the steering assembly.

Yet another way of indicating/defining the radius of curvature of an extruded curb is shown in FIGS. 16 and 17, in which there are seen spaced-apart holes 260 (shown only in FIG. 17) through steering rod 232, which extend along a specified length of steering rod 232 along its central region. Pins 261 are also provided, which are selectively engagable to holes 260. The required radius of curvature of an extruded curb is achieved by disposing pins 261 into specified holes 260 on either side of plates 241. When steering assembly 201 is turned with steering arm 224 to the left and to the right, pins 261, which function as stops, will encounter sides/surfaces of the plates 241, which function as abutments, preventing further turning of steering assembly 201 so as to define a specified turning radius. Any number of holes 260 and pins 261 can be used. Only one pin 261 can be used, if desired.

Referring to FIGS. 15, 16, 18 and 20, steering assembly 201 is furnished with a ratchet assembly 270 for permitting movement of apparatus 200 in only one direction, namely, forwardly so as to prevent backward movement of apparatus 200. In the present embodiment, ratchet assembly 270 consists of a ratchet wheel 271 affixed to wheel 220 and a ratchet pin or pawl 272 secured to fork 210, in which pawl 272 engages and interacts with the sloping teeth of ratchet wheel 271 permitting rotation of wheel 220 in only one direction, namely, forwardly. Ratchet wheel 271 is rigidly attached to the hub (or to the body) of wheel 220. Pawl 272 is moveable about a pivot point 273 (FIGS. 16, 18, and 20) attached to fork 210, permitting pawl 272 to pivot. Ratchet assembly 270 can be incorporates with wheel 221, if desired. In another embodiment, wheels 220,221 can each be fashioned with a ratchet assembly.

Figure 19:
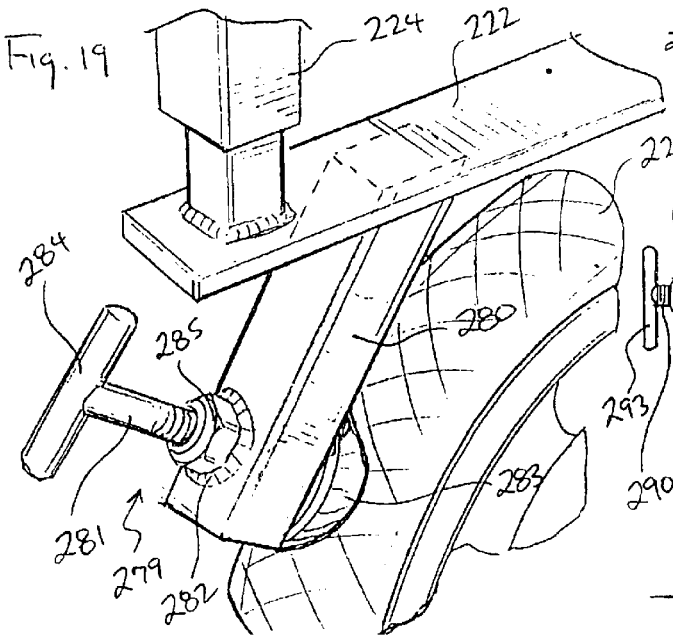
FIG. 19 is an enlarged perspective view of the brake of FIG. 18.

Looking to FIGS. 18 and 19, a brake assembly 279 is provided, which includes an elongate rigid support member 280 having an end secured, such as by welding, to the lower surface of fork bar 22 and extends downwardly and forwardly therefrom terminating with a distal end. A threaded rod 281 passes through a threaded opening 282 through the distal end of support member 280. A pad, disc or plate 283 is mounted on one end of rod 281. The other end of rod 281 carries an adjusting lever 284, for convenient rotation of rod 281 to cause the pad, disc or plate 283 to move toward and contact wheel 220 to act as a brake for wheel 220, or to move away from wheel 220 when a braking action is no longer required. A clamp nut 285 is also provided on rod 281 between adjusting lever 284 and support member 280, which may be tightened against support member 280 to lock rod 281 when the brake is applied to wheel 220, to maintain a required degree of braking of wheel 220. Although a threaded arrangement is preferred for facilitating the movement of threaded rod 281 toward and away from wheel 220, other arrangements can be employed for facilitating this adjustment. Brake assembly 279 can be associated with wheel 221, if desired. Although one brake assembly is shown, wheels 220,221 can each be fashioned with a brake assembly, if desired.

Figure 20:
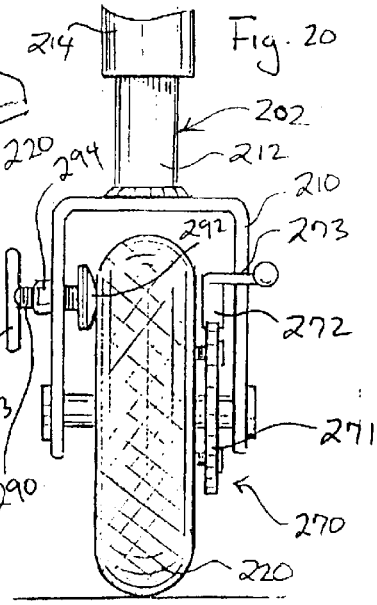
FIG. 20 is an enlarged fragmented front elevation of the wheel mechanism of FIG. 8 illustrating the ratchet assembly and an alternate placement of the brake.

FIG. 20 is illustrative of another brake assembly arrangement. In the embodiment set forth in FIG. 20, a threaded rod 290 passes through a threaded opening (not shown) through fork 210. A pad, disc or plate 292 is mounted on one end of rod 290. The other end of the rod 290 carries an adjusting lever 293, for convenient rotation of the threaded rod 290 to cause the pad, disc or plate 292 to move toward and contact wheel 220 to act as a brake or to move away from wheel 220 when a braking action is no longer required. A clamp nut 294 is also provided on rod 290, which may be tightened against fork 210 to lock rod 290 when the brake is applied to wheel 220, to maintain a required degree of braking of wheel 220. Although a threaded arrangement is preferred for facilitating the movement of threaded rod 290 toward and away from wheel 220, other arrangements can be employed for facilitating this adjustment. The brake assembly embodiment in FIG. 20 can be associated with wheel 221, if desired. Wheels 220,221 can each be provided with the brake assembly embodiment set forth in FIG. 20, if desired.

§G. Compaction Assembly

Figures 23A, 23B, 23C, 23D, 23E, 23F, 24, 25:
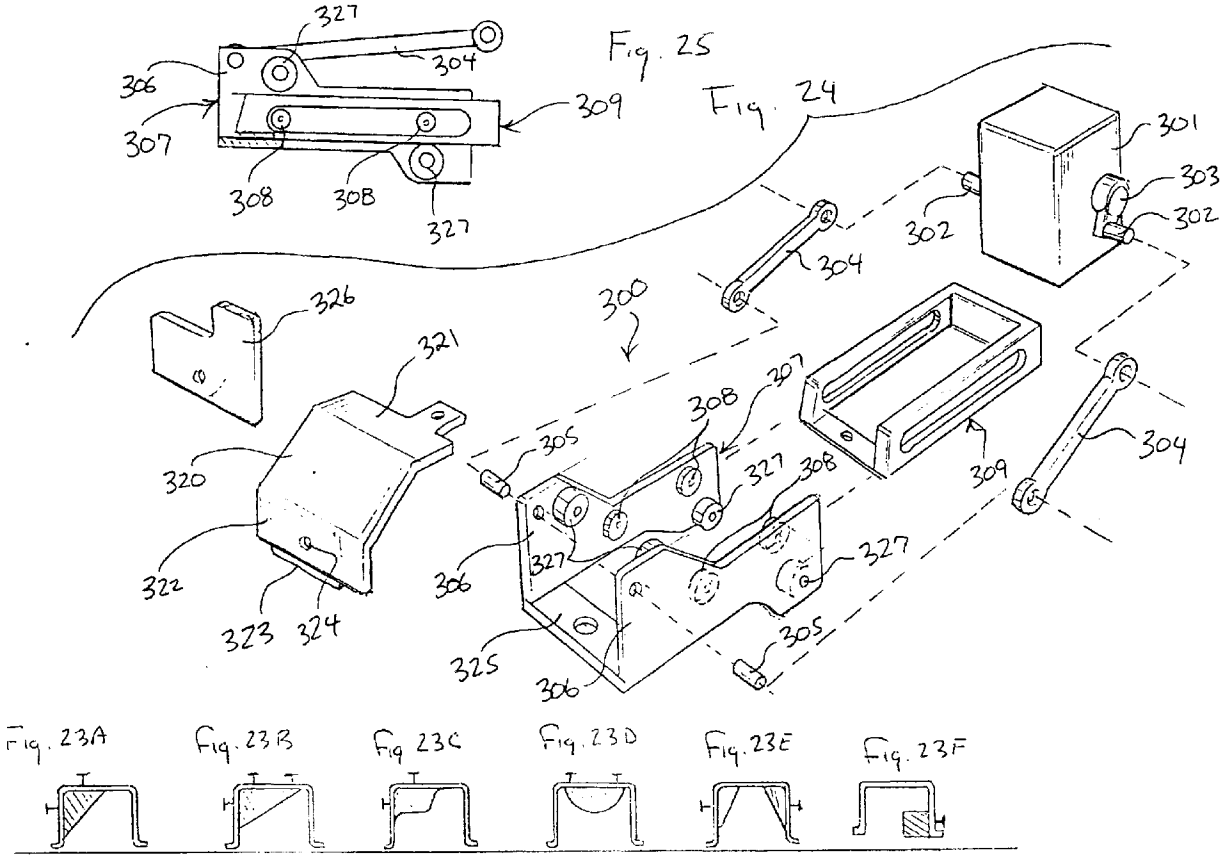
FIGS. 23A–23F are front elevations of extrusion molds illustrating various configurations of attached mold inserts.
FIG. 24 is an exploded perspective view of a compaction assembly including a motor and a ram plate assembly.
FIG. 25 is a sectional view illustrating the compaction assembly of FIG. 24 as it would appear assembled.

Like the embodiment designated 20 previously discussed, the embodiment designated 200 incorporates a compaction assembly for compacting and pushing hardenable material through mold 24, in which the compacting and pushing of hardenable material through mold 24 drives curb forming apparatus 200 in a direction leading with upstream end 41, leaving the extruded or molded curb trailing behind downstream end 42, as seen in FIG. 15. Turning now to FIG. 24, and improved compaction assembly 300 is disclosed, which can be used not only with the embodiment designated 200 but also with the embodiment designated 20.

Compaction assembly 330 consists of a motor 301 with respective pins 302 mounted off-center on each of its twin drive shafts 303. Respective connecting rods 304 connect pins 302 to pins 305 in arms 306 of a trolley 307 that is provided with wheels 308 that run in a track 309 mounted close to, and preferably lower than, motor 301. The usual bearings are used with pins 302, pins 305 and wheels 308.

A ram 320, in the form of a generally elongate steel plate, is formed to have a first end region 321 which, when in use, is substantially horizontal, and a second end region 322 which, when in use, is substantially vertical. The end region 321 is adapted to be mounted onto a cross-bar 325 of trolley 307. A ridge 323 adjacent to the lower edge of the end region 322, and an aperture 324 (in end region 322) are used to locate, then mount (using a bolt through aperture 324) a ram plate 326 onto end region 322. Ram plate 326 has a shape, which matches the cross-sectional shape of the mold of the curb forming apparatus, and can be readily changed if the mold is changed. Rotation of drive shafts 303 causes circular movement of pins 302, which translates into reciprocal movement of trolley 307 within track 309, and hence reciprocal movement of ram 320, and thus of ram plate 326. Trolley 307 is provided with stabilizing wheels 327 that run on the lower and upper ends of track 309 providing increased stabilization to trolley 307. FIG. 25 is a vertical sectional view illustrating the assembly of trolley 307 and track 309, in which wheels 308 run with track 309 and wheels 327 are disposed on the upper and lower ends of track 309 providing enhanced stability.

§H. Extrusion Molds with Attached Mold Inserts

Figure 22:
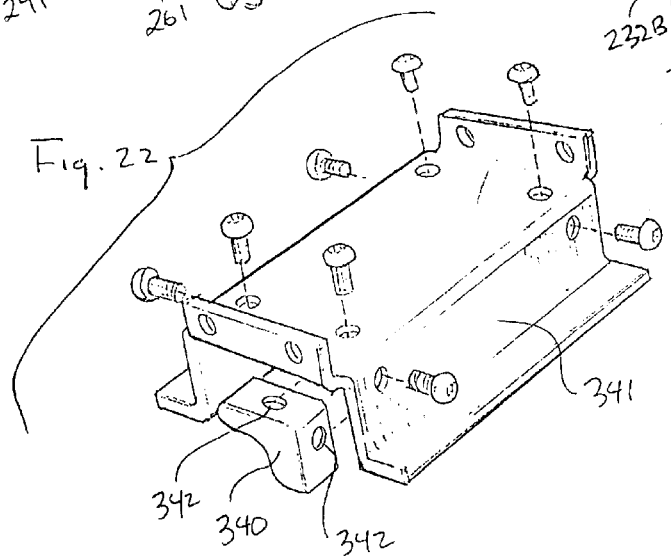
FIG. 22 is an isometric view of an extrusion mold and a mold insert engagable therewith.

If a minor variation of the cross-sectional shape of an extruded curb is required, an exemplary embodiment of the invention as set forth in FIG. 22 includes the provision of an insert 340, which is secured inside a mold 341 being used with a curb forming apparatus, such as with apparatus 20 or apparatus 200. Insert 340 is a body of specified shape made from steel or the like, which is provided with bolting points 342 for use in securely mounting insert 340 within and to mold 341 with bolts. When material is extruded through mold 341, insert 340 functions to impart a desired cross sectional shape to the extruded curb. Although it hardly seems worth mentioning, those having ordinary skill will readily appreciate that any suitable means of attaching insert 340 to mold 341 can be used. Examples of variously shaped such inserts and molds are set forth in FIGS. 23A-23F. Other shapes of such mold inserts can be provided for imparting any desired shape of an extruded curb. The provision of the described inserts is desirable, for they provide a way to alter the shape of extruded curbs without having to change out the mold, which is a frustrating and time-consuming process.

The present invention has been described above with reference to preferred embodiments. Those skilled in the art will recognize that changes and modifications may be made in the described embodiments without departing from the nature and scope of the invention. For instance, it is to be understood that steering assembly 201 discussed in connection with apparatus 200 can be used with the apparatus designated 20. It will also be understood that the brake assemblies discussed in connection with apparatus 200 as set forth in FIGS. 18-20 can be incorporated with the apparatus designated 20, and that ratchet assembly 270 discussed in connection with apparatus 200 can be used with the apparatus designated 20. It will further be understood that the positioning of engagement pairs can be reversed. Various changes and modifications to the embodiment herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. Curb forming apparatus comprising:

a device for receiving and pushing hardenable material through a channel defined by a mold of the device to form a curb having an outer surface;

a steering assembly attached to the device comprising a steering rod having a first end coupled to a first wheel support and a second end coupled to a second wheel support;

the steering rod movable between a first steering position and a second steering position;

the first and second wheel supports directed in a first direction in the first steering position of the steering rod;

the first and second wheel supports directed in a second direction in the second steering position of the steering rod;

the first direction being different from the second direction;

a stop, carried by the device, located adjacent the steering rod between the first and second ends thereof;

a hole through the steering rod between the stop and one of the first and second ends of the steering rod; and a pin removably couplable to the hole for interacting with the stop in response to movement of the steering rod for limiting movement of the steering rod between its first and second steering positions;

a wheel attached to one of the first and second wheel supports; and an attached ratchet assembly permitting rotation of the wheel in only one direction.

2. Curb forming apparatus of claim 1, further comprising:

first and second opposing parallel guides attached to the first and second wheel supports, respectively; and the first end of the steering rod reciprocated to the first guide and the second end of the steering rod reciprocated to the second guide.

3. Curb forming apparatus of claim 1, further comprising:

a first member rotated to the device; and means interacting between the first member and the first wheel support, in which rotation of the first member urges reciprocal movement of the first wheel support.

4. Curb forming apparatus of claim 1, further comprising:

a second member rotated to the device; and means interacting between the second member and the second wheel support, in which rotation of the second member urges reciprocal movement of the second wheel support.

5. Curb forming apparatus of claim 1, further comprising an attached brake movable between a first position away from the wheel and a second position engaging the wheel inhibiting it from rotating.

6. A curb formed with the curb forming apparatus of claim 1.

7. Curb forming apparatus comprising:

a device for receiving and pushing hardenable material through a channel defined by a mold of the device to form a curb having an outer surface; and a steering assembly attached to the device comprising a steering rod having a first end coupled to a first wheel support and a second end coupled to a second wheel support;

the steering rod movable between a first steering position and a second steering position;

the first and second wheel supports directed in a first direction in the first steering position of the steering rod;

the first and second wheel supports directed in a second direction in the second steering position of the steering rod;

the first direction being different from the second direction;

a stop, carried by the device, located adjacent the steering rod between the first and second ends thereof;

a hole through the steering rod between the stop and one of the first and second ends of the steering rod; and a pin removably couplable to the hole for interacting with the stop in response to movement of the steering rod for limiting movement of the steering rod between its first and second steering positions.

8. Curb forming apparatus of claim 7, further comprising:

first and second opposing parallel guides attached to the first and second wheel supports, respectively; and the first end of the steering rod reciprocated to the first guide and the second end of the steering rod reciprocated to the second guide.

9. Curb forming apparatus of claim 8, further comprising:

a first member rotated to the device; and means interacting between the first member and the first wheel support, in which rotation of the first member urges reciprocal movement of the first wheel support.

10. Curb forming apparatus of claim 8, further comprising:

a second member rotated to the device; and means interacting between the second member and the second wheel support, in which rotation of the second member urges reciprocal movement of the second wheel support.

11. Curb forming apparatus of claim 7, further comprising:

a wheel attached to one of the first and second wheel supports; and an attached ratchet assembly permitting rotation of the wheel in only one direction.

12. Curb forming apparatus of claim 11, further comprising an attached brake movable between a first position away from the wheel and a second position engaging the wheel inhibiting it from rotating.

13. A curb formed with the curb forming apparatus of claim 7.

14. Curb forming apparatus comprising:

a device for receiving and pushing hardenable material through a channel defined by a mold of the device to form a curb having an outer surface; and a steering assembly attached to the device comprising:

first and second wheel supports reciprocated to the device;

first and second opposing parallel guides attached to the first and second wheel supports, respectively;

a steering rod having a first end reciprocated to the first guide and a second end reciprocated to the second guide the steering rod movable between a first steering position and a second steering position;

the first and second wheel supports directed in a first direction in the first steering position of the steering rod;

the first and second wheel supports directed in a second direction in the second steering position of the steering rod;

the first direction being different from the second direction;

a stop, carried by the device, located adjacent the steering rod between the first and second ends thereof;

a hole through the steering rod between the stop and one of the first and second ends of the steering rod; and a pin removably couplable to the hole for interacting with the stop in response to movement of the steering rod for limiting movement of the steering rod between its first and second steering positions.

15. Curb forming apparatus of claim 14, further comprising:

a first member rotated to the device; and means interacting between the first member and the first wheel support, in which rotation of the first member urges reciprocal movement of the first wheel support.

16. Curb forming apparatus of claim 14, further comprising:

a second member rotated to the device; and means interacting between the second member and the second wheel support, in which rotation of the second member urges reciprocal movement of the second wheel support.

17. Curb forming apparatus of claim 14, further comprising:

a wheel attached to one of the first and second wheel supports; and an attached ratchet assembly permitting rotation of the wheel in only one direction.

18. Curb forming apparatus of claim 17, further comprising an attached brake movable between a first position away from the wheel and a second position engaging the wheel inhibiting it from rotating.

19. A curb formed with the curb forming apparatus of claim 14.

* * * * *